United States Patent [19]

Kondo et al.

[11] 4,400,964

[45] Aug. 30, 1983

[54] METHOD AND DEVICE FOR CONTINUOUS PRODUCTION OF FLANGED HOLLOW ARTICLE

[75] Inventors: Kazuyoshi Kondo, Okazaki; Yoshiaki Nakamura, Tsu, both of Japan

[73] Assignee: Kabushiki Kaisha Wako, Iwata, Japan

[21] Appl. No.: 193,221

[22] Filed: Oct. 2, 1980

Related U.S. Application Data

[60] Continuation of Ser. No. 950,978, Oct. 13, 1978, abandoned, which is a division of Ser. No. 843,886, Oct. 20, 1977.

[30] Foreign Application Priority Data

Oct. 21, 1976 [JP] Japan ..... 51-126553

[51] Int. Cl.[3] ..... B21C 23/14; B21C 25/04; B21D 45/00

[52] U.S. Cl. ..... 72/265; 72/353; 72/354; 72/359; 72/379

[58] Field of Search ..... 72/264, 265, 347, 348, 72/349, 353, 354, 359, 370, 379

[56] References Cited

U.S. PATENT DOCUMENTS

| | | | |
|---|---|---|---|
| 3,050,849 | 8/1962 | Etchison, Jr. et al. | 72/348 |
| 3,387,481 | 6/1968 | Harvey et al. | 72/379 |
| 3,977,225 | 8/1976 | Couchman | 72/265 |

FOREIGN PATENT DOCUMENTS

| | | | |
|---|---|---|---|
| 407618 | 12/1973 | U.S.S.R. | 72/354 |
| 487702 | 10/1975 | U.S.S.R. | 72/359 |

*Primary Examiner*—Lowell A. Larson

*Attorney, Agent, or Firm*—Fitzpatrick, Cella, Harper & Scinto

[57] ABSTRACT

A blank material having a configuration corresponding to the flange part of the article is first punched by a punch member and a die member from a planar strip material, the blank is press-formed into a hollow article by further pressing the punch member and die member and projecting a mandrel having outer diameter corresponding to the inner diameter of the hollow article. Then, the punch member, die member and mandrel are returned to their original position thereby to deliver a completed article. The above one cycle operation is continuously repeated per shift of the strip member by one article distance.

1 Claim, 30 Drawing Figures

FIG. 3(III)
PRIOR ART
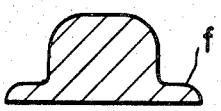

FIG. 6 (II)
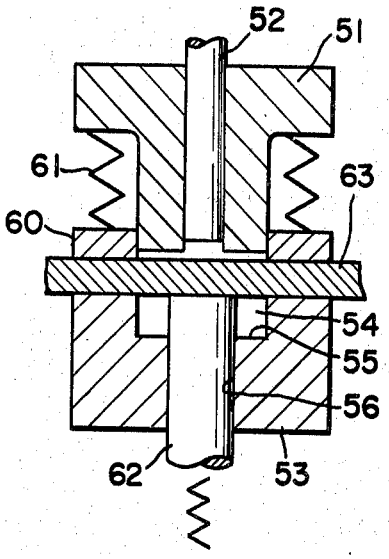
FIG. 6 (III)
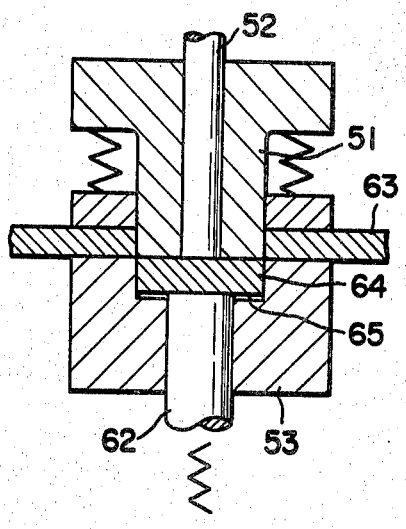
FIG. 6 (IV)
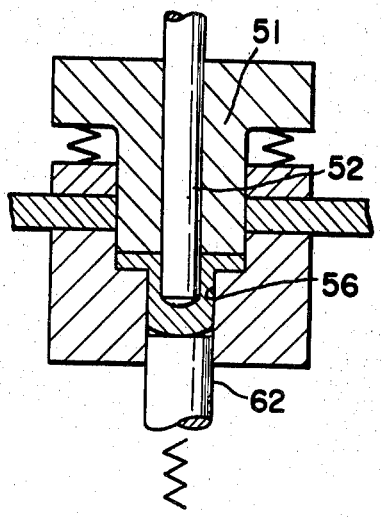
FIG. 6 (V)
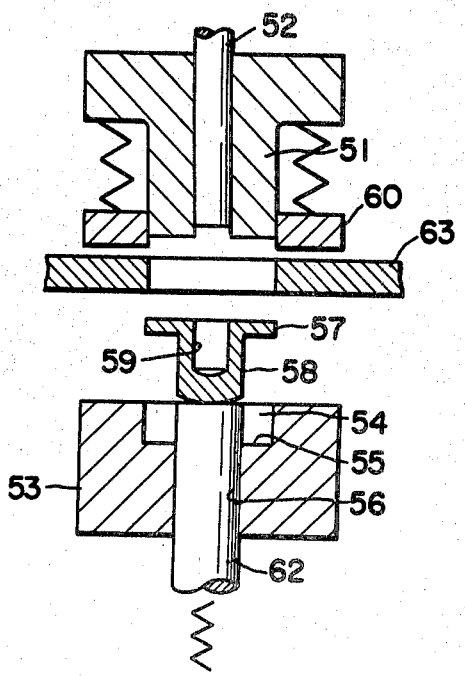

METHOD AND DEVICE FOR CONTINUOUS PRODUCTION OF FLANGED HOLLOW ARTICLE

This is a continuation of application Ser. No. 950,978, filed Oct. 13, 1978, now abandoned, which in turn was a division of application Ser. No. 843,886, filed Oct. 20, 1977.

BACKGROUND OF THE INVENTION

This invention relates to a method and device for continuously press-forming a hollow article having a flange by utilizing a method of forming materials by plastic deformation.

There are a great variety of hollow articles having flanges at their ends, such as hollow hat-shaped bodies a (having a blind hole) as shown in FIG. 1, and gear blanks o (having through holes) as shown in FIG. 2. Conventional methods for producing these articles are shown in FIGS. 3(I)–3(IV).

The method shown in FIG. 3 for producing a hollow hat-shaped article having a blind hole internally comprises cropping a bar material into a blank d as shown in FIG. 3(I), smoothing both ends thereof and providing the blank with a tapered surfaces e as shown in FIG. 3(II), providing by swaging a flange part f as shown in FIG. 3(III), and forming the outside of a hollow part g and the internal hole h therein as shown in FIG. 3(IV) by forcing a mandrel into the hole h. This method requires not only four steps of operation, inclusive of one for material cropping into a blank, but also a great force in piercing the mandrel into the blank for press-forming the hollow part g. This force is applied through an area not wider than the cross-sectional area of the mandrel, thus entailing disadvantageous features such as buckling of the mandrel and shortening of the operational life of the same. Although there are methods for drilling and shaping the internal bore, these methods are not suitable for quantity or mass production and for reasons of economy.

SUMMARY OF THE INVENTION

A primary object of the invention is to provide a method and device for continuously producing hollow articles with flanges out of a strip material or the like, regardless of whether the internal holes of the articles are blind holes or whether they are through holes, wherein a blank is punched out of the material and is press-formed into the hollow article in one cycle of operation.

Said object and other objects of the present invention have been efficiently attained by the following method and device. Namely, a punch member and a die member having a die hole with bottom are arranged in opposition in a mutually approachable manner; a mandrel adapted to form the internal hole of the hollow article is provided through either one of the two members; a through hole cooperative with the mandrel for forming the outer contour of the hollow main part of the article is provided through the other one of said two members; a material blank having a configuration corresponding to the flange part of the article is first punched out of a large size planar strip material by the punching member and the die member; the material blank is press-formed into the hollow article by further pressing the two members and projecting the mandrel; then the two members are separated from each other; and the completed article is delivered. The above described one cycle of operation is repeated on the succeeding parts of the material a number of times as required in a continuous manner.

The nature, principle, and the utility of the present invention will be made apparent from the following detailed description of the invention when read in conjunction with the accompanying drawings.

BRIEF DESCRIPTION OF THE DRAWINGS

In the drawings:

FIGS. 6(I) through 6(V) are longitudinal sectional views showing various stages of the operation for practicing the invention in continuously producing hollow articles having flanges from a strip material; and

DETAILED DESCRIPTION

Figure 1:
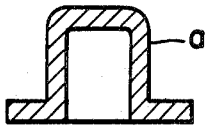
FIG. 1 is a longitudinal sectional view of a hat-shaped structure which constitutes an example of hollow products having flanges.

A press-forming method constituting a basic process according to the present invention will be first described with reference to FIGS. 4(I) and 4(II).

A punch member 1 having a through hole 5 at the center, a clamping ring 2 fitting around the punch member 1, and a die member 3 are assembled together as shown with a piece of material 6 placed in a space defined by and between these three members.

Upon depression of the punch member 1 toward the die member 3, the peripheral part of the material 6 is deformed and reduced in volume, whereby an inward flow of the material is caused, resulting in a rising up of the central part of the material into the through hole 5 of the punch 1 and forming a recess 15 in the lower central part of the material. This phenomenon has been known as a "recess forming step" appearing at the final stage of a conventional extrusion process. Theoretically it is considered that the phenomenon occurs when the thickness of a part of the material coming under the punch member 1 is reduced to approximately 0.73 to 0.88 times the radius of the through hole p.

When the thickness of the planar material in the aforementioned part is reduced to a value less than approximately 0.5 times the radius of the through hole 5, the formation of the recess 15 becomes significant, the material being formed into a hat shape. Although an attempt has been made to utilize the phenomenon in the production of articles, successful results could not be obtained because of the uneven thickness and unpleasant appearance of the hollow part of the product.

Figure 4I:
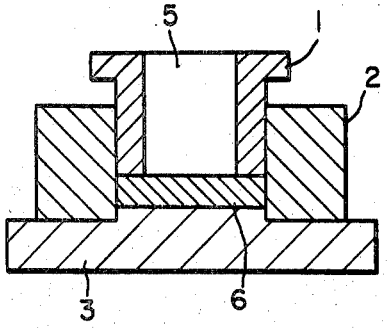
FIGS. 4(I) and 4(II) are longitudinal sectional views showing an initial stage and a final stage of a press forming operation constituting a basic process step of this invention, during which a recess forming phenomenon occurs.
Figure 4:
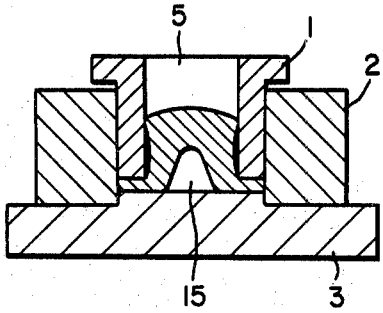
Figure 5I:
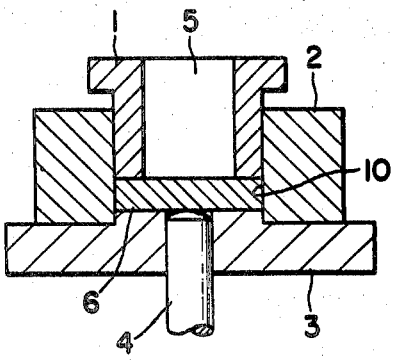
FIGS. 5(I) and 5(II) are longitudinal sectional views showing an initial stage and a final stage, respectively, in the operation of a tool for practicing the present invention.
Figure 5:
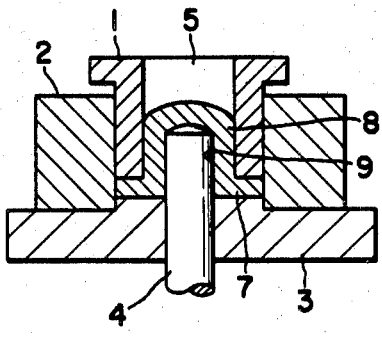

A basic example of the invention for producing a hat-shaped product by utilizing the basic process as shown in FIGS. 4(I) and 4(II) is illustrated in FIGS. 5(I) and 5(II). This device is intended to produce a hollow hat-shaped article a having a flange as shown in FIG. 1.

The device comprises: a punch member 1 having an outer diameter equal to that of the flange part 7 of the product and also having a central through hole 5 whose inner diameter is equal to the outer diameter of the hollow main part 8 of the product; a clamping ring 2 fitted around the punch member 1 with a sliding fit; and a die member 3 provided beneath the clamping ring 2 in a tight-fit relation. Through a hole at the center of the die member 3, a mandrel 4 having an outer diameter equal to the inner diameter of the internal bore 9 of the hollow product is passed in a slidable manner. In a space 10 formed between the punch member 1, clamping ring 2, and the die member 3, and having a diameter equal to the outer diameter of the flange part 7 of the product, a piece of material 6 of a planar shape having a diameter substantially equal to or smaller than the diameter of the space 10 is inserted as shown in FIG. 5(I).

While the material 6 to be worked is thus pressed between the punch member 1 and the die member 3, the mandrel 4 is forced into the space 10. Under the pressing force between the punching member 1 and the die member 3, the peripheral part of the material 6 is formed into the flange part 7 of the product, the central part of the material 6 being raised within the through hole 5 in the punch member 1, and a recess tending to be formed in the central lower surface of the material 6 is shaped by the mandrel 4 projected therein into the internal bore 9 of the product. By this process, an even thickness can be obtained for the wall of the hollow main part 8 of the product, and a hollow article with a flange of a neat shape as shown in FIG. 5(II) can be produced in a single step of operation.

The rate of the projection of the mandrel 4 relative to the rate of augmenting the pressing action between the punch member 1 and the die member 3 must be kept in a constant relation with the ratio of the cross-sectional area of the hollow product to the cross-sectional area of the flange part 7 thereof (i.e. the press-forming ratio). However, in practice, a required projection rate of the mandrel 4 can be automatically obtained in accordance with an increase in the pressing force between the punch member 1 and the die member 3.

In this case, by selecting the load of the mandrel 4 at a higher value than that required, and by positively driving the mandrel at the aforementioned rate, the force required for driving the punch member 1 can be substantially reduced. It should be noted, however, that when the load of the mandrel is elevated excessively, the tension in the hollow main part 8 of the product is elevated thereby reducing the thickness of the wall until a partial contraction is exhibited. Therefore, an upper limit always exists in the load applicable to the mandrel 4.

In a practical example of the present invention, a punch member 1 having a 24-mm outer diameter and a 15-mm inner diameter and a mandrel 4 of 10-mm outer diameter were used for press-forming a circular plate 6 made of pure aluminum of 4-mm thickness and 24-mm diameter into a hollow product having a flange until a wall thickness of 2 mm was obtained. In this operation, when the load applied to the mandrel 4 was selected at 0.4 metric ton, the squeezing load required for the punch member 1 was 12.5 tons. For every increases of 0.1 ton in the load applied to the mandrel 4, the squeezing load applied to the punch member 1 was reduced by one ton. The load applied to the mandrel could not be elevated above 0.7 ton because a contracted part was formed in the hollow main part 8 of the product as described above.

According to the production method shown in FIGS. 5(I) and 5(II) of this invention, not only the required force for the mandrel, but also the squeezing load applied to the punch member can be reduced to a comparatively small value. For the purpose of comparing the load for the mandrel in this example to that in the conventional method, a hole corresponding to that produced in this example was formed in the same pure aluminum plate under application of the same load on the mandrel, but without application of the squeezing load of the punch member. It was found that only approximately 20 percent of the depth of this example could be obtained. According to the present invention, there is no possibility of buckling or damaging the mandrel, the the operational life of the mandrel can be substantially elongated.

Figure 2:
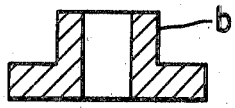
FIG. 2 is a longitudinal sectional view of a gear blank with a through hole which constitutes an example of another type of hollow products having flanges.
Figure 3I:
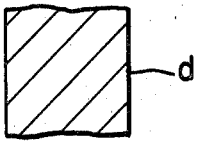
FIG. 3(I) PRIOR ART
FIGS. 3(I), 3(II), 3(III), and 3(IV) are longitudinal sectional views illustrating conventional process steps in the fabrication of a hat-shaped body as shown in FIG. 1.
Figure 3:
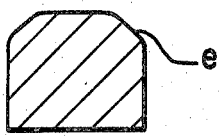
FIG. 3(II) PRIOR ART
Figure 3:
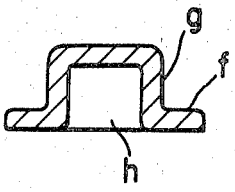
FIG. 3(IV) PRIOR ART

In cases where articles having through holes such as a gear blank b as shown in FIG. 2 are produced, a die hole cooperatively operating with the mandrel 4 at the upper end of the punch member 1 is used. The inner diameter of the die hole is selected to be slightly greater than that of internal bore of the product so that a punching clearance is maintained therebetween. The die hole may otherwise be provided in a separate member integrally secured to the upper part of the punch member 1. In either of these cases, the upper end of the mandrel 4 is formed into a specific shape adapted for executing a punching operation.

Although a product having circular cross section has been indicated above, it is apparent that a product of a polygonal contour or a spline-toothed contour can be obtained by the use of a punch member 1 and a mandrel 4 having outer and inner configurations corresponding to the contour of the product.

Now the present invention relates to a method and device for continuously producing hollow articles with flanges out of a strip material or like by utilizing skillfully the basic process as described in connection with FIGS. 5(I) and 5(II).

An example of the present invention will now be described in connection with FIGS. 6(I) through 6(V).

In this example, use is made of: a punching member 51, the outer diameter of which is equal to that of the flange part 57 of the product; a mandrel 52 provided in the punch member slidably, and having an outer diameter equal to the diameter of the internal hole 59 of the product; and a die member 53 having a die hole 54, with bottom 55, of a diameter equal to the outer diameter of the flange part 57 of the product, and also having a through hole 56 of an inner diameter equal to the outer diameter of the hollow main part of the product, provided through the bottom 55. The punch member 51 and the die member 53 are disposed in an opposed relation so as to be pressed against each other. A material clamping member 60 is provided in a freely slidable relation around the punch member 51, to be forced against a strip material 63 by the force of a spring 61. Furthermore, an ejector 62 is provided in a through hole 56 in the die member 53. The material 63 may be steel strip or the like.

Figure 6I:
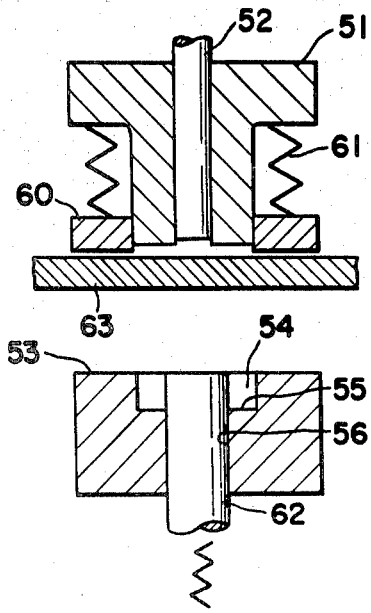

In the operation, the strip material 63 is set between the punch member 51 and the die member 53 as shown in FIG. 6(I), and the two members 51 and 53 are brought together, clamping the strip material 63 therebetween as shown in FIG. 6(II). Then, the punch member 51 is forced downward so that a material blank 64 having an outer diameter equal to that of the flange part 57 of the product is punched out of the strip material 63 between the punch member 51 and the die member 53. At this time the material blank 64 remains in the die hole 54 as shown in FIG. 6(III).

The punch member 51 is further pressed downward thereby to compress the material blank 64 between the bottom surface 55 of the die hole 54 and the punch member 51, and the mandrel 52 is projected downwardly through the punch member 51. The peripheral part of the material blank 64 is press-formed into the flange part 57 of the product, and a part of the material forced toward the central part of the die hole 54 flows into a through hole 56 provided for passing the ejector 62, thereby creating a recess in the upper suface at the center of the material blank. The projection of the mandrel 52 assists the flow of the material while shaping the recess into the internal hole 59 of the product and also shaping the outer contour of the blank so as to provide a uniform wall thickness in the hollow main part 58 of the product. An integral product having a hollow plug-shaped body with a flange can thus be press-formed in one step as shown in FIG. 6(IV).

The punch member 51, the die member 53, and the mandrel 52 are then retracted to the original positions, and the product is ejected by the ejector 62 out of the through hole 56 and the die hole 54 as shown in FIG. 6(V).

After the production of a hat-shaped product as described above, the strip material 63 is shifted horizontally by one step of a predetermined distance, thus bringing the operation back to a state as shown in FIG. 6(I). The above described process steps are repeated for the new positions of the material successively, and the hat-shaped products can be produced continuously.

In the above described example, it is possible, of course, to provide another die hole in the upper end surface of the ejector 62 at a position corresponding to the tip of the mandrel 52, thereby changing the internal blind hole 59 to a through hole.

According to the present invention, the phenomenon wherein when a material is confined outwardly and the peripheral part thereof is press-formed by a punch having an internal hole into a flange part of a article, the central part of a strip material is raised into the internal hole of the die by the material flow and a recess is formed in the opposite side surface of the material is utilized. By forcing a mandrel into the recess, the internal hole of the product article is formed while positively aiding the formation of the recess, and the press formation of a hollow product with a flange can be accomplished in one step. Furthermore, said one step can be easily and successively repeated while shifting the strip material per completion of one article, so that the cost and the time required for the continuous production of hollow articles with flanges can be substantially reduced.

We claim:

1. A method for continuously producing hat-shaped hollow articles each having a flange, which comprises the steps of:

feeding a planar strip material between a punch member for punching the outer contour of the flange and a die member having a die hole with a bottom, said punch member and die member being disposed in an opposed and mutually approachable relation so that said strip material is clamped between said members, said punch member being provided with a mandrel adapted to pass slidably through a central hole thereof and having an outer contour corresponding to the inner contour of the internal hole of the article, and said die member being provided with a central through hole having a diameter corresponding to the outer diameter of the hollow part of the article and having an ejector provided slidably in said central through hole;

pressing said punch member toward said die hole of the die member so that a blank piece having a peripheral outer surface corresponding to that of the flange of said article is firstly cut out of said strip material and is dropped in said die hole, then continuing the pressing together of said punch and die members so that the flange of the blank piece is press-formed while causing a flow and protrusion of the blank material into said through hole of the die member so as to form a recess hole in the blank material;

projecting said mandrel of the punch member into said recess hole of the blank material simultaneously with said pressing while retracting said ejector thereby to form completely the hollow part of the article;

returning said punch member, die member, mandrel and ejector to their respective starting positions to thereby eject a completely shaped article;

shifting the strip material by one step of a predetermined distance; and repeating the above-mentioned steps upon said shifting of the strip material.

* * * * *

UNITED STATES PATENT AND TRADEMARK OFFICE

CERTIFICATE OF CORRECTION

PATENT NO. : 4,400,964

DATED : August 30, 1983

INVENTOR(S) : KAZUYOSHI KONDO, ET AL.

It is certified that error appears in the above-identified patent and that said Letters Patent is hereby corrected as shown below:

Column 4, line 17, change "the" (first occurrence) to --and--.

Signed and Sealed this

*Eighth* Day of *November 1983*

[SEAL]

*Attest:*

GERALD J. MOSSINGHOFF

*Attesting Officer*

*Commissioner of Patents and Trademarks*